US007320475B2

(12) United States Patent
Couderc

(10) Patent No.: US 7,320,475 B2
(45) Date of Patent: Jan. 22, 2008

(54) DEVICE FOR RETAINING A FOOT OR A BOOT ON A SPORTS APPARATUS

(75) Inventor: Bernard Couderc, Annecy (FR)

(73) Assignee: Salomon S.A., Metz-Tessy (FR)

( * ) Notice: Subject to any disclaimer, the term of this patent is extended or adjusted under 35 U.S.C. 154(b) by 243 days.

(21) Appl. No.: 11/148,355

(22) Filed: Jun. 9, 2005

(65) Prior Publication Data

US 2005/0280247 A1 Dec. 22, 2005

(30) Foreign Application Priority Data

Jun. 21, 2004 (FR) ..... 04 06696

(51) Int. Cl.
*A63C 9/08* (2006.01)

(52) U.S. Cl. ..... 280/617; 280/624; 280/14.24

(58) Field of Classification Search ..... 280/14.21, 280/14.22, 14.24, 842, 623–626, 634, 635
See application file for complete search history.

(56) References Cited

U.S. PATENT DOCUMENTS 5,044,654 A * 9/1991 Meyer ..... 280/613
5,261,689 A 11/1993 Carpenter et al. ..... 280/618
D346,419 S 4/1994 Carpenter ..... D21/230
5,690,351 A * 11/1997 Karol ..... 280/618
5,975,557 A 11/1999 Snoke et al. ..... 280/624
6,015,161 A * 1/2000 Carlson ..... 280/626
6,062,584 A * 5/2000 Sabol ..... 280/607
6,109,643 A 8/2000 Bayer et al. ..... 280/624
6,126,179 A * 10/2000 Dodge ..... 280/14.22
6,290,250 B1 * 9/2001 Karol ..... 280/618
6,302,427 B1 * 10/2001 Karol ..... 280/613
6,315,305 B1 * 11/2001 Gien ..... 280/14.24
6,343,809 B1 2/2002 Karol ..... 280/613
6,443,478 B1 * 9/2002 Keller et al. ..... 280/624

FOREIGN PATENT DOCUMENTS

DE 297 00 631 U1 7/1997

* cited by examiner

*Primary Examiner*—Lesley D. Morris
*Assistant Examiner*—Bridget Avery
(74) *Attorney, Agent, or Firm*—Greenblum & Bernstein, P.L.C.

(57) ABSTRACT

A device for retaining a foot or a boot on a sports apparatus. The base of the device, having the general shape of a plate, includes a zone for anchoring to the apparatus, as well as at least one zone for fastening a foot or boot retaining mechanism, the fastening zone being apart from the anchoring zone. Stiffening ribs extend between the anchoring zone and the fastening zone. Two adjacent stiffening ribs converge toward the fastening zone, between the anchoring zone and the fastening zone.

21 Claims, 3 Drawing Sheets

Fig. 4
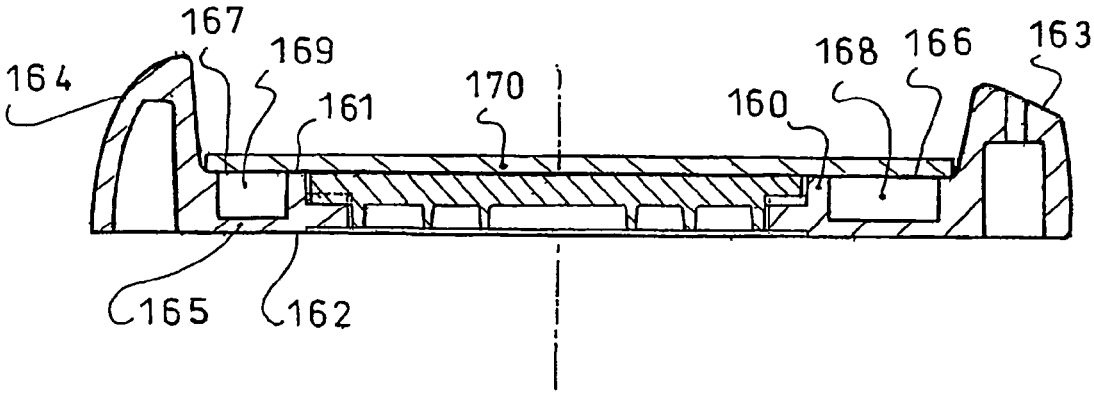
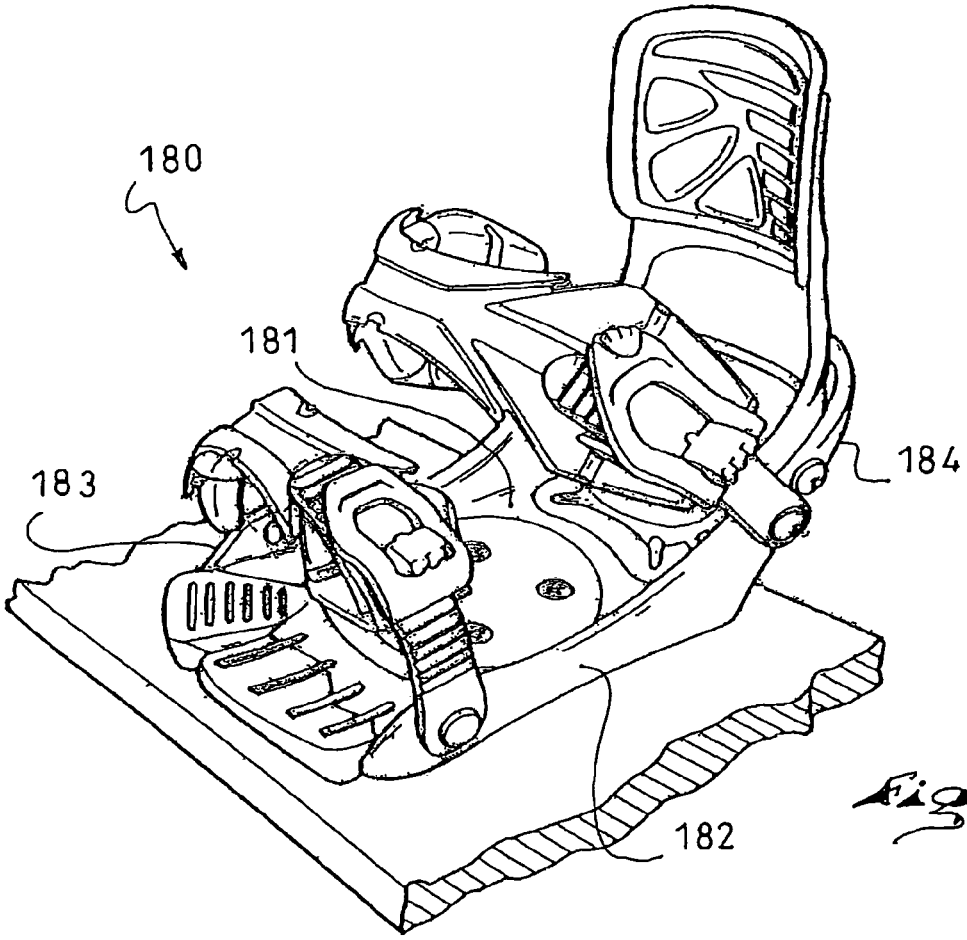
Fig. 5

DEVICE FOR RETAINING A FOOT OR A BOOT ON A SPORTS APPARATUS

CROSS-REFERENCE TO RELATED APPLICATION

This application is based upon French Patent Application No. 04.06696, filed on Jun. 21, 2004, the disclosure of which is hereby incorporated by reference thereto in its entirety and the priority of which is hereby claimed under 35 U.S.C. §119.

BACKGROUND OF THE INVENTION

1. Field of the Invention

The present invention relates to a device for retaining a foot or a boot on a sports apparatus, and more particularly to a device having a base for mounting the device on the sports apparatus.

More particularly, the invention is directed to such devices for use in the fields of snowboarding, snow skiing, water skiing, snow shoeing, roller-skating, or the like.

2. Description of Background and Relevant Information

A retaining device of the aforementioned type generally has a base for supporting the foot or the boot.

The base is in the form of a plate that has a zone for securing the device to the apparatus. For example, the anchoring zone can be defined by an opening in the base for receiving a disk the disk itself being attached to the apparatus.

The base has at least one zone for fastening a foot or boot retaining mechanism, the fastening zone being separated from the anchoring zone.

Stiffening ribs extend between the anchoring zone and the fastening zone, so that the base is both mechanically strong and as light as possible.

Frequently, the arrangement of the ribs provides the bottom of the base with a honeycombed appearance, the top having a more even surface. In fact, the objective is to reach a good compromise between the technical and aesthetic characteristics.

Thus, the base is capable of withstanding the forces associated with the steering of the apparatus, while being attractive.

However, incipient fractures, even fractures themselves, have been observed under particular circumstances.

For example, if the apparatus hits an obstacle, or if the user/rider has an extreme steering style, the base can be subjected to forces beyond its nominal capabilities.

In order to deal with these exceptional situations, it has been proposed to reinforce the base. Generally speaking, such reinforcement involves an increase in the quantity of material and, consequently, an increase in weight.

This latter consequence has a negative effect on the control of the apparatus and the performance characteristics of the apparatus.

SUMMARY OF THE INVENTION

In view of the foregoing, one of the objects of the invention is to improve the mechanical strength of a base without increasing its weight, or with as small a weight increase as possible.

Consequently, one of the objects of the invention is to provide the greatest stiffness/rigidity and strength for a given weight.

To this end, the invention provides a device for retaining a foot or a boot on a sports apparatus, the device having a base, the base having a zone for anchoring to the apparatus, as well as at least one zone for fastening a foot or boot retaining mechanism, the fastening zone being separate from the anchoring zone, stiffening ribs extending between the anchoring zone and the fastening zone.

Two adjacent stiffening ribs of the retaining device, according to the invention, converge toward the fastening zone, between the anchoring zone and the fastening zone.

As a result, the ribs form a group, between the fastening zone and the anchoring zone, which is narrowed toward the fastening zone and widened out toward the anchoring zone.

This arrangement of the ribs promotes an even distribution of the mechanical forces/stresses in the base. When steering the board, the forces applied in the area of a fastening zone are distributed in a more homogeneous fashion. In other words, the concentrations of stress are substantially reduced, even eliminated, in comparison with the distributions observed in the bases according to the prior art.

A resulting advantage is a better mechanical strength, for both localized and occasional forces and repeated forces. Fatigue strength is markedly improved, and incipient fractures are rare, even nonexistent.

BRIEF DESCRIPTION OF DRAWINGS

Other characteristics and advantages of the invention will be better understood by means of the following description, with reference to the attached drawings showing how the invention can be embodied, according to non-limiting embodiments, and in which:

FIG. 4 is similar to FIG. 2, showing a second embodiment of the invention;

FIG. 5 is similar to FIG. 1, showing a third embodiment of the invention.

DETAILED DESCRIPTION OF THE INVENTION

Although the embodiments illustrated and described below relate more particularly to the field of snowboarding, it is to be understood that they also apply to other fields as mentioned hereinabove.

The first embodiment is described hereinafter with reference to FIGS. 1-3.

Figure 1:
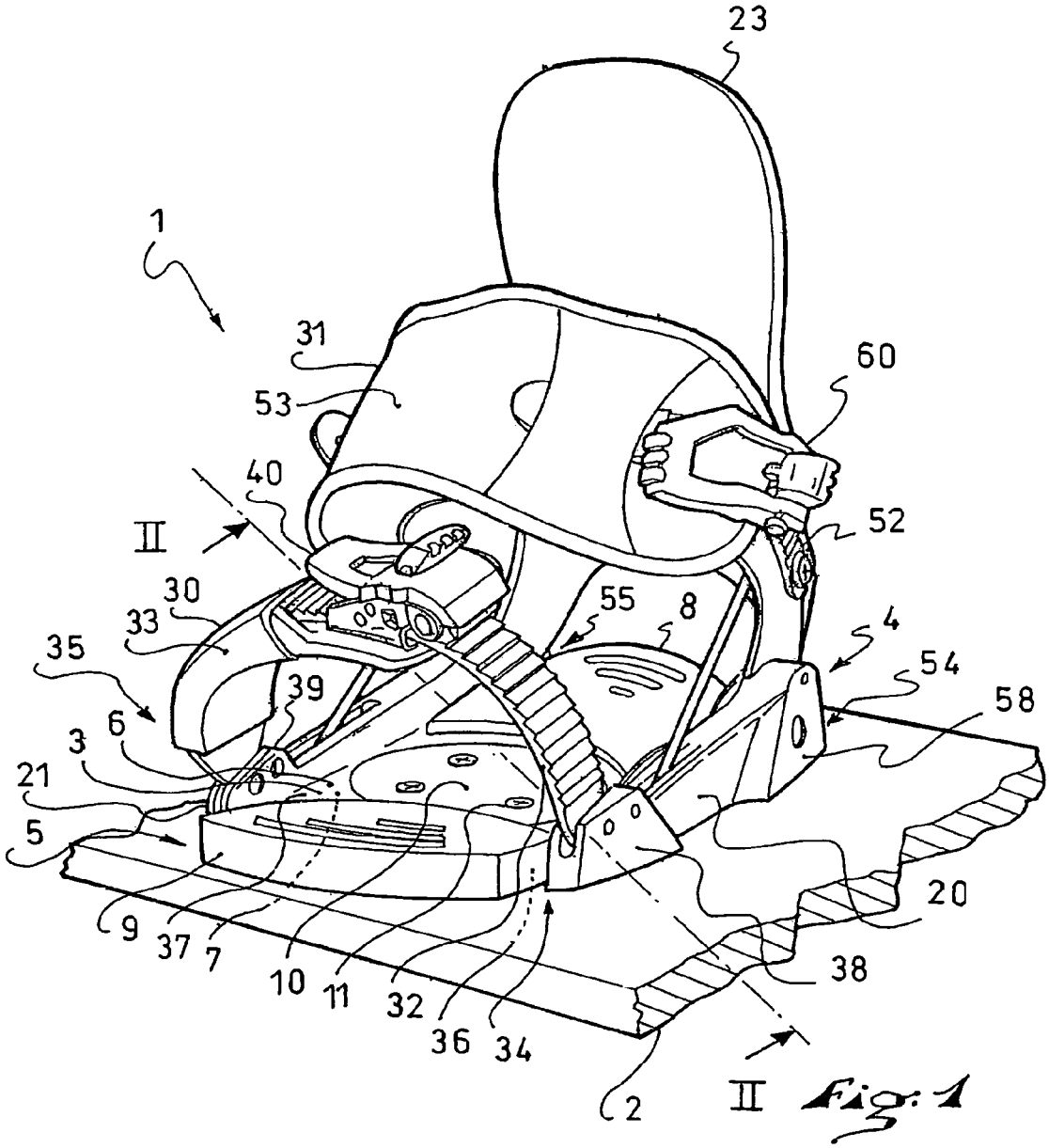
FIG. 1 is a front perspective view of a retaining device according to a first embodiment of the invention.

As seen in FIG. 1, a retaining device 1 enables the temporary retention of a boot, not shown, on a board 2.

In a known manner, the retaining device 1 has a base 3 having the general form of a plate, which extends longitudinally between a rear end 4 and a front end 5.

The base 3 has an upper surface 6 provided to be on the side of the boot, i.e., facing the boot, and a bottom surface 7 provided to be on the side of the board 2, i.e., facing the board.

A rear pad 8 and a front pad 9 are provided to absorb board steering forces. The pads are located in the area of the rear end 4 and the front end 5, respectively. However, one could alternatively use a single pad that extends along the base, or yet other additional pads.

One can also provide not to use a pad, the boot taking support directly on the base 3 in such case.

The base 3 is secured to the board 2 by an anchoring mechanism that includes a disk 10, which is in turn secured to the board by means of screws 11.

Figure 2:
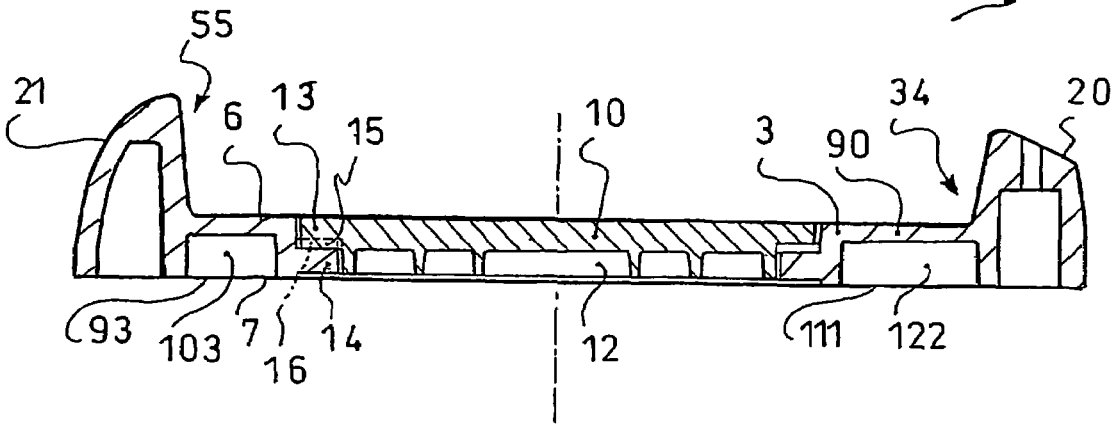
FIG. 2 is a cross-section along the line II-II of FIG. 1.

As seen in FIG. 2, the anchoring mechanism also includes an anchoring zone that is substantially demarcated by an opening 12 of the base 3. To retain the base 3, the disk 10 is housed in the opening 12. The disk 10 has a shoulder 13 that cooperates with a circular groove 14 of the base 3, extending around a periphery of the opening 12.

The shoulder can be replaced by a chamfer, a truncated portion, or the like. In any case, the circular groove has a geometry that is compatible with that of the disk.

A mechanism for rotationally immobilizing the base 3 in relation to the disk 10 is provided: This mechanism is made in the form of pair of toothings, one 15 being arranged on the disk 10, in the area of the shoulder 13, the other 16 being arranged on the base 3, in the area of the circular groove 14.

Any other structure for the immobilizing mechanism can be suitable according to the invention, such as friction surfaces, or removable latching mechanisms. The mechanism for anchoring the binding can simply involve arranging screws in a zone for anchoring the base, the screws being screwed in the board.

Figure 3:
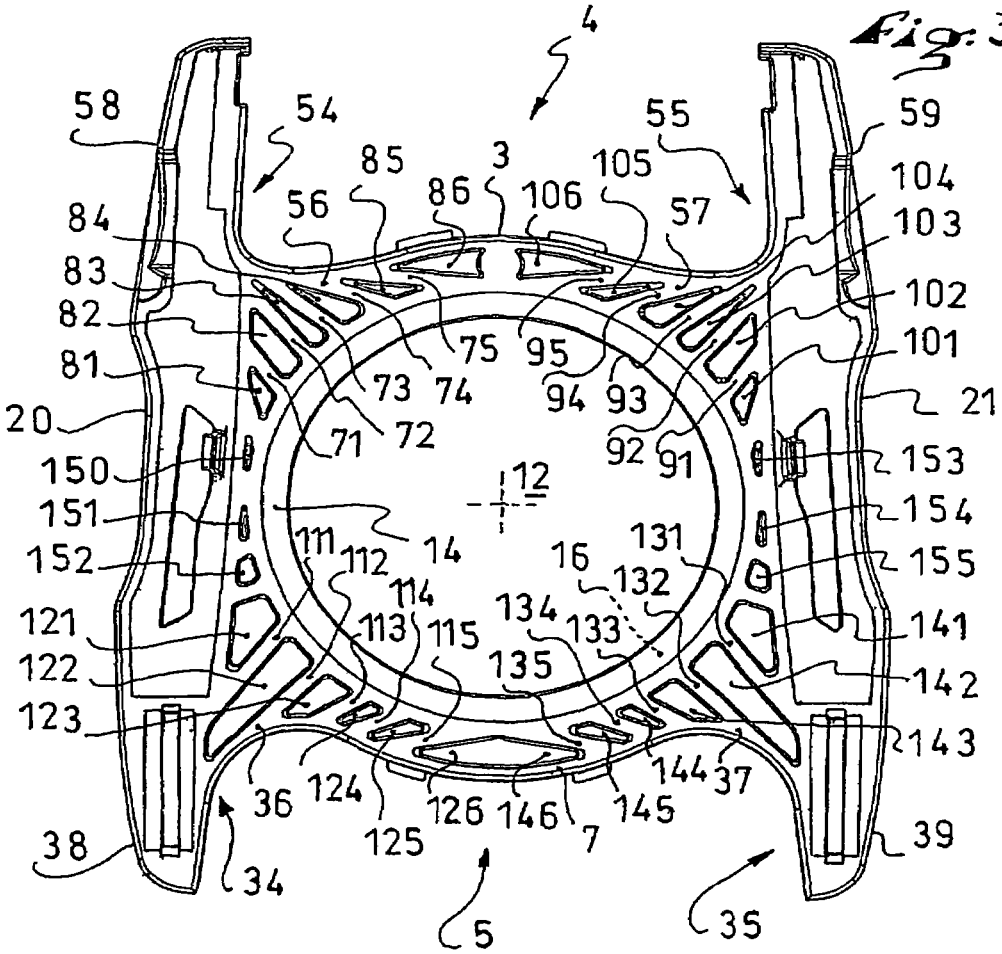
FIG. 3 is a bottom view of the base of the device of FIG. 1.

As seen in FIGS. 1 and 3, the base 3 is transversely bordered with a lateral flange 20 and a medial flange 21. Each of the flanges forms a lateral or medial portion, respectively, of the device 1 to demarcate a zone 22 for receiving the boot. When the boot is positioned on the device 1, the flanges 20, 21 extend laterally along the sole. Alternatively, something other than the flanges 20, 21 could be provided to form the lateral and medial portions. For example, mere lateral and medial abutments, such as upwardly extending unitary projections of the base, could be used.

Preferably, the base 3 and the flanges 20, 21 form a unitary element made, for example, of a synthetic material. However, the flanges can be provided to be elements that are affixed to the base by any means, such as glue, welding, screws, or the like.

The device 1 also has a rear support element 23, or highback, so that the rider can be rearwardly supported at the lower leg.

A mechanism for retaining the foot or the boot on the device 1 is also provided. In the illustrated embodiment, such mechanism is provided in the form two linkages or straps for removably retaining the boot on the base 3, between the flanges 20, 21, in the receiving zone 22.

A first linkage 30 is located toward the front, in the area of the metatarsophalangeal articulation, when the foot is retained. A second linkage 31 is located toward the rear, in the area of the instep, when the foot is retained.

Each of the linkages 30, 31 extends transversely between the flanges 20, 21.

Alternatively, a different number of linkages could be provided.

For example, the first linkage 30 has a lateral portion 32 and a medial portion 33, which are attached in the area of a front lateral fastening zone 34 and of a front medial fastening zone 35, respectively, of the device.

According to the illustrated first embodiment, the front fastening zones 34, 35 have front portions 36, 37, respectively, of the base 3 that are located at a distance from the opening 12, on the one hand, and in the area where the base 3 is joined with the lateral 20 and medial 21 flanges, on the other hand.

The front fastening zones 34, 35 also have front portions 38, 39 of the lateral 20 and medial 21 flanges, respectively.

The lateral 32 and medial 33 portions of the first/front linkage 30 are attached to the lateral 20 and medial 21 flanges, respectively. In other words, the portions 32, 33 are indirectly attached to the base.

Alternatively, the portions 32, 33 can be directly attached to the base 3.

A first connecting device 40 makes it possible to reversibly connect the lateral 32 and medial 33 portions to one another. The connecting device 40 makes it possible to tighten the boot to a desired level.

Similarly, the second/rear linkage 31 has, for example, a lateral portion 52 and medial portion 53, which are attached in the area of a rear lateral fastening zone 54 and of a rear medial fastening zone 55, respectively, of the device.

According to the illustrated first embodiment, the rear fastening zones 54, 55 have rear portions 56, 57, respectively, of the base 3 that are located at distance from the opening 12, on the one hand, and in the area where the base 3 is joined with the lateral 20 and medial 21 flanges.

The rear fastening zones 54, 55 also have rear portions 58, 59 of the lateral 20 and medial 21 flanges, respectively.

The lateral 52 and medial 53 portions of the second linkage 31 are attached to the lateral 20 and medial 21 flanges, respectively. In other words, the portions 52, 53 are indirectly attached to the base.

Here again, one can alternatively provide that the portions 52, 53 of the second linkage be directly attached to the base 3.

A second connecting device 60 makes it possible to reversibly connect the lateral 52 and medial 53 portions to one another. The connecting device 60 makes it possible to tighten the boot to a desired level.

Generally speaking, the first 30 and second 31 linkages are made of relatively flexible and relatively inextensible materials. For example, they can comprise synthetic materials, such as polyamide or polyurethane, whether reinforced or non-reinforced with fibers.

The fastenings of the linkages 30, 31 to the flanges 20, 21, or to the base, can include any component, such a swivel pin, a screw, a nut, a rivet, or the like.

As shown in FIGS. 2 and 3, the base 3 includes stiffening ribs that are located between the anchoring zone 12 and at least one fastening zone 34, 35, 54, 55.

According to the invention, as seen in FIG. 3, two adjacent stiffening ribs converge along a direction extending from the anchoring zone toward the fastening zone.

For example, in the case of the rear lateral fastening zone 54, an assembly is provided, in a non-limiting fashion, which includes first 71, second 72, third 73, fourth 74 and fifth 75 stiffening ribs. These ribs 71, 72, 73, 74, 75 successively separate first 81, second 82, third 83, fourth 84, fifth 85 and sixth 86 cavities. According to the invention, five ribs and six cavities are not limiting; the number of ribs and cavities could be provided in larger or small numbers. Further, to the extent the ribs are defined along their lengths by the cavities, the ribs extend along a part of the distance between the anchoring zone and the fastening zones in the embodiment shown in FIG. 3.

According to the illustrated first embodiment, each stiffening rib is substantially rectilinear.

Two adjacent ribs 71, 72, 73, 74, 75 converge toward the rear lateral fastening zone 54, i.e., the closest fastening zone. This means that they form an angle, the apex of which faces the rear lateral fastening zone 54.

By extension, two spaced apart ribs, i.e., ribs which are non-adjacent but are contained in the same assembly, also converge toward the fastening zone 54. The consequence is that the ribs 71, 72, 73, 74, 75, are widened out toward the opening 12, i.e., toward the anchoring zone.

An advantage of this structural arrangement is a better distribution in the base 3 of the steering forces that transmitted through the rear/second linkage 31. Each traction force on the linkage 31 induces flexion forces in the base 3, between the fastening zone 54 and the anchoring zone 12. These forces are distributed along the opening 12, opposite the ribs 71, 72, 73, 74, 75, due to the widening of these ribs in the area of the opening 12. Consequently, the stresses are reduced, and the mechanical strength of the base is improved.

Alternatively, one can provide curved or concave ribs, or a combination of curved/concave and straight ribs. Such arrangement is done in the same context: they converge toward the fastening zone 54 and they diverge toward the anchoring zone.

According to the illustrated first embodiment, as shown in particular in FIGS. 2 and 3, the ribs 71, 72, 73, 74, 75 are arranged so as to project downwardly with respect to a core 90 of the base 3. The ribs are located on the side of the bottom surface 7 of the base 3, the core 90 being on the side of the top surface 6. This provides a good compromise between the mechanical properties and the mass, i.e., the advantage of a relatively high mechanical strength and a relatively low weight. Thus, the base 3 of the invention is both solid and lightweight.

Alternatively, the ribs can be arranged on the side of the top surface 6, i.e., projecting upwardly or the ribs can be connected to one another without the help of the core 90. In this latter case, the base 3 resembles a perforated plate.

According to the illustrated first embodiment, the ribs 71, 72, 73, 74, 75 and the core 90 form a unitary element, i.e., a one-piece element, which is the base 3. For example, a synthetic material or a metallic alloy can be used to make the base 3, with its core and ribs. The molding technique can be adapted accordingly by one of ordinary skill in the art.

However, other techniques, such as machining, can be provided in place of molding.

One can also provide that the ribs be attached on the core by any means known to one with ordinary skill in the art, such as gluing, welding, or the like.

The stiffening ribs 71, 72, 73, 74, 75 have substantially constant thicknesses, which enables a uniform distribution of the stresses therein. This also facilitates the injection molding of the base 3.

The various stiffening ribs 71, 72, 73, 74, 75 each have substantially the same thickness here. This also facilitates the use of injection molding.

However, ribs with different thicknesses can alternatively be provided.

The cavities 81, 82, 83, 84, 85, 86 have different shapes with respect to one another. This aids in organizing the orientation of the stiffening ribs.

The contours of the cavities include straight portions and curved or concave portions. The straight portions serve to demarcate the stiffening ribs. The curved portions connect the straight portions. Thus, the contour of a cavity 81, 82, 83, 84, 85, 86 has a slight curvature, or no curvature, discontinuity. This prevents the occurrence of incipient fractures. The mechanical strength of the base 3 is also improved.

Generally speaking, the assembly of the base 3 is structured in the context of the rear lateral fastening zone.

The other fastening zones 55, 34, 35 are briefly described hereinafter.

Similar to the rear lateral fastening zone 54, the rear medial fastening zone 55 includes first 91, second 92, third 93, fourth 94, and fifth 95 stiffening ribs. The medial fastening zone 55 also includes first 101, second 102, third 103, fourth 104, fifth 105, and sixth 106 cavities.

The reference numerals 91, 92, 93, 94, 95, 101, 102, 103, 104, 105, 106, for the rear medial fastening zone 55, correspond to the reference numerals 71, 72, 73, 74, 75, 81, 82, 83, 84, 85, 86, respectively, of the rear lateral fastening zone 54. Indeed, the base 3 is symmetrical along a central longitudinal axis. Consequently, the stiffening ribs and the cavities are symmetrically arranged, for the rear lateral 54 and medial 55 fastening zones.

Alternatively, the invention encompasses a non-symmetrical arrangement as well.

The front lateral fastening zone 34 includes first 111, second 112, third 113, fourth 114, and fifth 115 stiffening ribs. The fastening zone 34 also includes first 121, second 122, third 123, fourth 124, fifth 125, and sixth 126 cavities located on both sides of the ribs.

Here again, the ribs converge toward the fastening zone 34.

Similarly, the front medial fastening zone 35 includes first 131, second 132, third 133, fourth 134, and fifth 135 stiffening ribs. The fastening zone 35 also includes first 141, second 142, third 143, fourth 144, fifth 145, and sixth 146 cavities located on both sides of the ribs.

Here again, the stiffening ribs and the cavities of the front fastening zones 34, 35 are arranged symmetrically. The reference numerals 111, 112, 113, 114, 115, 121, 122, 123, 124, 125, 126, for the front lateral fastening zone 34, correspond to the reference numerals 131, 132, 133, 134, 135, 141, 142, 143, 144, 145, 146, respectively, of the front medial fastening zone 35.

The arrangement of the stiffening ribs and cavities is not the same at the rear and at the front. Indeed, the base 3 is not symmetrical along a transverse axis. In fact, the base 3 is wider toward the front end 5 in order to adapt to the morphology of the foot or boot.

Complementarily, additional lateral 150, 151, 152 and medial 153, 154, 155 cavities are provided between the rear and front cavities. These additional cavities contribute to making the base 3 lighter, without altering its mechanical strength.

Other embodiments of the invention are described hereinafter. For reasons of convenience, only those elements that are necessary for the understanding are used.

For the second embodiment, as seen in FIG. 4, the base 160 of a retaining device has a top surface 161 opposite a bottom surface 162. The base 160 is transversely bordered with a lateral flange 163 and a medial flange 164. The base 160 has a core 165 that supports ribs such as those designated by the reference numerals 166, 167. Cavities, such as those designated by the reference numerals 168, 169, are formed between the ribs.

In comparison with the first embodiment, the ribs and the cavities, in the second embodiment, are on the side of the top surface 161, i.e., toward the boot. The core 165 is therefore turned toward the board. Thus, the center of gravity of the base 160, and therefore of the device, is lowered. Moreover, the core 165 is biased in traction when the base 160 tends to bend due to traction on a linkage/strap. When the core works in traction, it opposes a greater mechanical resistance. This improves the stiffness of the base 160.

In a non-limiting manner, a cap 170 covers all or part of the ribs and cavities, on the side of the top surface 161. The cap 170 can be flexible in order to provide comfort or, conversely, more rigid in order to improve the transmission of sensory information. The cap 170 is retained on the base 160 by any means known to one with ordinary skill in the art, such as screwing, gluing, nesting, or the like.

The third embodiment of the invention is described with reference to FIG. 5.

A retaining device 180 has a base 181 that is bordered transversely by a lateral flange 182 and a medial flange 183. An arch 184, shown elevated from the base and rearward of the rear support element, connects the flanges 182, 183 to one another toward the rear of the device. Here, the base 181, the flanges 182, 183 and the arch 184 form a unitary/one-piece element made, for example, of a plastic material. However, one can provide that the arch be affixed to the flanges by any means, such as by means of screws.

Generally speaking, the invention is constructed from materials and according to implementation techniques that are known to one with ordinary skill in the art.

The invention makes it possible to optimize the quantity of material necessary for the manufacture, and to use low density and low cost materials, such as polycarbonates or polyamides.

The invention is not limited to particulars of the detailed embodiments described and shown, and encompasses all equivalents that fall within the scope of the claims that follow.

In particular, any combination of shapes for the stiffening ribs and cavities can be provided.

The base can be symmetrical or asymmetrical along a longitudinal axis or plane, such as a longitudinal vertical median plane.

The invention claimed is:

1. A device for retaining a foot or boot on a sports apparatus, the device comprising:

a base including a zone for anchoring the device to the sports apparatus and at least one zone for fastening a foot or boot retaining mechanism, the fastening zone being spaced from the anchoring zone, stiffening ribs extending between the anchoring zone and the fastening zone, two adjacent stiffening ribs converging toward the fastening zone, between the anchoring zone and the fastening zone.

2. A retaining device according to claim 1, wherein:

a rear lateral fastening zone has five stiffening ribs that separate six cavities;

a rear medial fastening zone has five stiffening ribs that separate six cavities;

a front lateral fastening zone has five stiffening ribs that separate six cavities;

a front medial fastening zone has five stiffening ribs that separate six cavities.

3. A retaining device according to claim 1, wherein:

two stiffening ribs, said two stiffening ribs being non-adjacent but contained in the same assembly, converge toward a closest fastening zone.

4. A retaining device according to claim 1, wherein:

the stiffening ribs are substantially rectilinear.

5. A retaining device according to claim 1, wherein:

the stiffening ribs have substantially a constant thickness.

6. A retaining device according to claim 1, wherein:

the stiffening ribs are arranged so as to project downwardly relative to a core of the base, the stiffening ribs being located on the side of a bottom surface of the base, the stiffening ribs and the core forming a unitary one-piece element.

7. A retaining device according to claim 1, wherein:

the stiffening ribs are arranged so as to project upwardly relative to a core of the base, the stiffening ribs being located on the side of the top surface of the base.

8. A retaining device according to claim 1, wherein:

the base is symmetrical.

9. A retaining device according to claim 1, wherein:

the base is transversely bordered with lateral and medial flanges;

the base includes a front lateral fastening zone and a front medial fastening zone of a first linkage, and a rear lateral fastening zone and a rear medial fastening zone of a second linkage;

a mechanism for anchoring the device includes the anchoring zone demarcated by an opening of the base, a disk being housed in the opening.

10. A retaining device according to claim 1, wherein:

the base is transversely bordered with lateral and medial flanges;

an arch connects the lateral and medial flanges to one another.

11. A retaining device according to claim 2, wherein:

the rear stiffening ribs and the rear cavities are arranged symmetrically along a longitudinal median plane of the base;

the front stiffening ribs and the front cavities are arranged symmetrically along a longitudinal median plane of the base.

12. A retaining device according to claim 2, wherein:

the cavities include straight portions and curved portions.

13. A device for retaining a foot or boot on a sports apparatus, the device comprising:

a base comprising:

an anchoring zone, said base being adapted to be anchored to the sports apparatus at said anchoring zone;

a fastening zone to fasten a foot or boot retention mechanism;

the fastening zone being spaced from the anchoring zone;

a plurality of stiffening ribs extending in a direction from the anchoring zone to the fastening zone;

two adjacent stiffening ribs of said plurality of stiffening ribs extending along at least part of a distance between the anchoring zone and the fastening zone;

along said part of said distance, said two adjacent stiffening ribs of the plurality of stiffening ribs converging in said direction extending from the anchoring zone to the fastening zone.

14. A retaining device according to claim 13, further comprising:

a disk;

said anchoring zone comprises an opening in the base;

said disk being structured and arranged to be housed within said opening and supported at a periphery of said opening, said disk adapted to be anchored to the sports apparatus to secure the base to the sports apparatus.

15. A retaining device according to claim 13, further comprising:

said foot or boot retention mechanism;

said foot or boot retention mechanism comprises a strap adapted to extend over the foot or boot.

16. A retaining device according to claim 14, wherein:

the base is transversely bordered by a lateral flange and a medial flange;

the base includes a front lateral fastening zone and a front medial fastening zone for fastening a first linkage, and a rear lateral fastening zone and a rear medial fastening zone for fastening a second linkage.

17. A retaining device according to claim 14, further comprising:

a rear support element for supporting a rear of a lower leg of a user.

18. A snowboard binding for retaining a boot on a snowboard, the snowboard binding comprising:

a base for supporting the boot, said base having a length extending between a rear end and front end;

a lateral flange and a medial flange, said flanges extending upwardly relative to said base and forming a zone for receiving the boot;

a front strap extending between the lateral and medial flanges;

an instep strap extending between the lateral and medial flanges;

said base comprising:

an anchoring zone, said base being adapted to be anchored to the snowboard at said anchoring zone;

a fastening zone positioned along the length of the base where one of said front and instep straps are fastened;

the fastening zone being spaced from the anchoring zone;

a plurality of stiffening ribs extending in a direction from the anchoring zone to the fastening zone;

two adjacent stiffening ribs of said plurality of stiffening ribs extending along at least part of a distance between the anchoring zone and the fastening zone;

along said part of said distance, said two adjacent stiffening ribs of the plurality of stiffening ribs converging in said direction extending from the anchoring zone to the fastening zone.

19. A snowboard binding according to claim 18, further comprising:

a disk;

said anchoring zone comprises an opening in the base;

said disk being structured and arranged to be housed within said opening and supported at a periphery of said opening, said disk adapted to be anchored to the sports apparatus to secure the base to the sports apparatus.

20. A snowboard binding according to claim 19, wherein:

the base includes a front lateral fastening zone and a front medial fastening zone for fastening said front strap, and a rear lateral fastening zone and a rear medial fastening zone for fastening said instep strap.

21. A snowboard binding according to claim 19, further comprising:

a rear support element for supporting a rear of a lower leg of a user.

* * * * *